US005732986A

United States Patent [19]

Piva

[11] Patent Number: 5,732,986

[45] Date of Patent: Mar. 31, 1998

[54] DOOR LOCK

[76] Inventor: Lino Piva, 240 Kenilworth Avenue North, Hamilton, Ontario, Canada, L8H 4S5

[21] Appl. No.: 772,585

[22] Filed: Dec. 26, 1996

Related U.S. Application Data

[60] Provisional application No. 60/009,250, Dec. 26, 1995.

[51] Int. Cl.[6] ..... E05C 1/00; E05C 5/00

[52] U.S. Cl. ..... 292/5; 292/67; 292/69; 292/DIG. 17; 292/DIG. 51

[58] Field of Search ..... 292/5–7, 32, 33, 292/145, DIG. 9, DIG. 17, DIG. 51, 67, 69, 338; 16/326

[56] References Cited

U.S. PATENT DOCUMENTS 3,811,150 5/1974 Chalmers ..... 292/DIG. 9
3,969,788 7/1976 McCullough ..... 292/DIG. 17
5,080,354 1/1992 McDougall ..... 292/DIG. 17
5,509,235 4/1996 Chander ..... 292/DIG. 17

*Primary Examiner*—Neill R. Wilson
*Attorney, Agent, or Firm*—Rogers & Scott

[57] ABSTRACT

A door lock has a base securable to a door or door frame, and a locking arm pivotally connected to the base and movable when the base is secured to the door or the door frame to a blocking position where the door is prevented from opening and a retracted position where the locking arm is retracted from the door locking position. The locking arm is biased to the retracted position to facilitate closing the door when the base is secured to the door or to the door frame. A locking device is slidably mounted on the base for sliding movement to a locking position in a direction parallel to the plane of the door to engage the locking arm and hold the locking arm in the blocking position against the biasing when the door is closed, thereby locking the door. The door is unlocked by sliding movement of the locking device to an unlocking position in a direction opposite to the first mentioned direction to become disengaged from the locking arm, whereby the biasing returns the locking arm to the retracted position.

3 Claims, 3 Drawing Sheets

DOOR LOCK

This invention claims priority from Provisional Patent Application No. 60/009,250 filed Dec. 26, 1995.

This invention relates to door locks.

My U.S. Pat. No. 5,280,977 issued Jan. 25, 1994, the contents of which are hereby incorporated herein by reference, describes and claims a door lock with a locking arm which is biased to a non-locking retracted position.

The present invention provides an alternative to the door locks described in the above mentioned patent.

SUMMARY OF THE INVENTION

According to the invention, a door lock comprises a base securable to a door or door frame, and a locking arm pivotally connected to the base and moveable when the base is secured to the door or the door frame to a blocking position where the door is prevented from opening and a retracted position where the locking arm is retracted from the door locking position. Biasing means biases the locking arm to the retracted position to facilitate closing the door when the base is secured to the door or to the door frame. Locking means are slidably mounted on the base for sliding movement to a locking position in a direction parallel to the plane of the door to engage the locking arm and hold the locking arm in the blocking position against the biasing means when the door is closed thereby locking the door. The door is unlocked by sliding movement of the locking means to an unlocking position in a direction opposite to the first mentioned direction to become disengaged from the locking arm, whereby the biasing means returns the locking arm to the retracted position.

The door lock may have a hinge pin pivotally connecting the locking arm to the base, said biasing means comprising a spring mounted on the hinge pin and having opposite ends engaging the base and the locking arm respectively to bias the locking arm to the retracted position.

The base may have a main body and a plate member perpendicular thereto, the base having upper and lower edges bent over to form guides in which the locking means is slidably mounted, and the plate member having holes to enable the plate member to be secured to the door frame by screws passing through the holes into the door frame.

The main body of the base may have a stop operable to limit sliding movement of the locking means in an unlocking direction, and the locking means may have a stop which engages the main body of the base to limit movement of the locking means in the locking direction.

BRIEF DESCRIPTION OF THE DRAWING

Embodiments of the invention will now be described, by way of example, with reference, to the accompanying drawings, in which.

DESCRIPTION OF THE PREFERRED EMBODIMENTS

Figure 1:
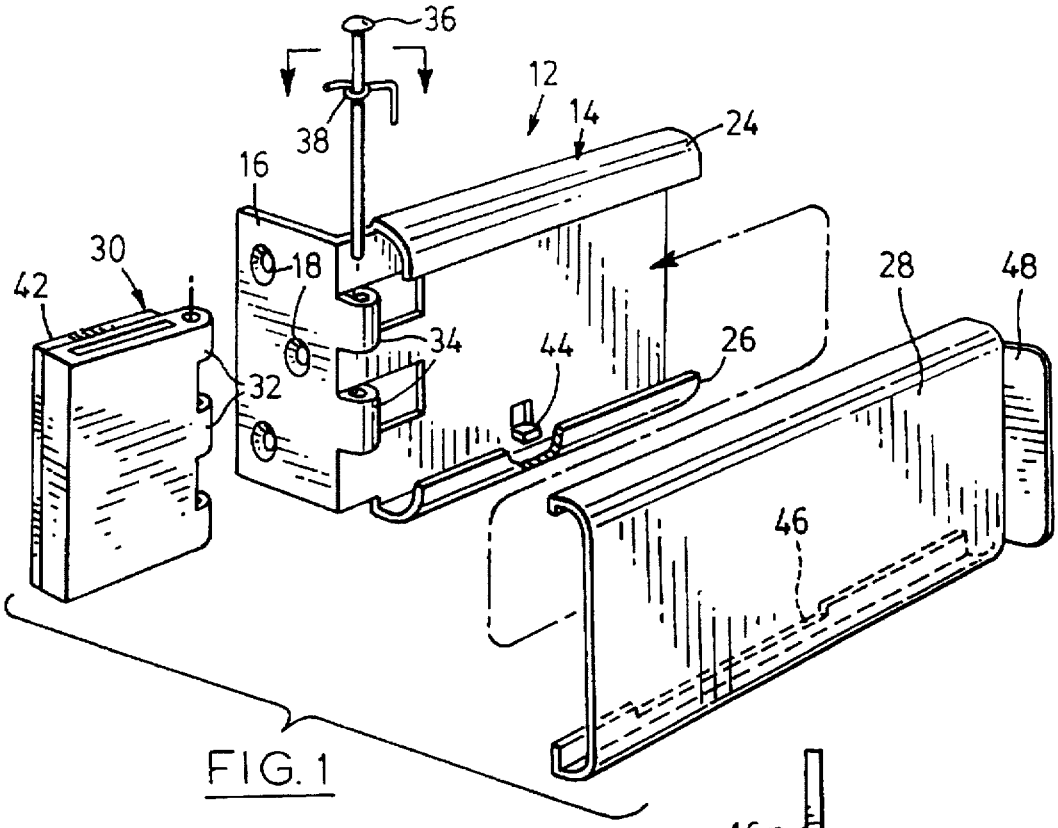
FIG. 1 is an exploded perspective view of a door lock in accordance with one embodiment of the invention.
Figure 2:
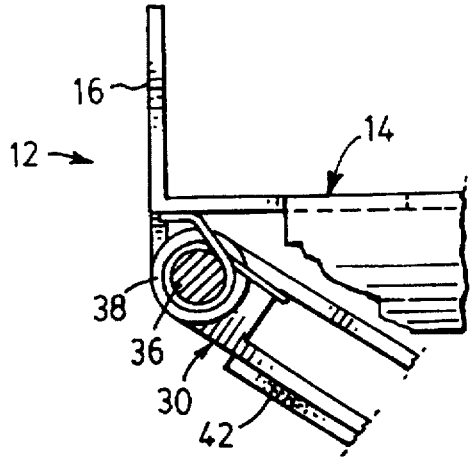
FIG. 2 is a section view along the lines 2—2 of FIG. 1.

Referring first to FIGS. 1 to 5, a door lock has a base 12 with a main body 14 and a plate member 16 perpendicular thereto with holes 18 to enable the plate member 16 to be secured to a door frame 20 by screws 22. The upper and lower edge of the main body 14 are bent over to form guides 24, 26 in which a locking member 28 is slidably mounted.

A locking arm 30 is pivotally connected to the base 12, the locking arm 30 having hinge portions 32 which engage with hinge portions 34 on the base 12 and are retained in assembly therewith by a hinge pin 36. A spring 38 mounted on the hinge pin 36 has opposite ends engaging the base 12 and the locking arm 30 respectively to bias the locking arm 30 to the retracted position shown in FIGS. 2 and 3.

Figure 3:
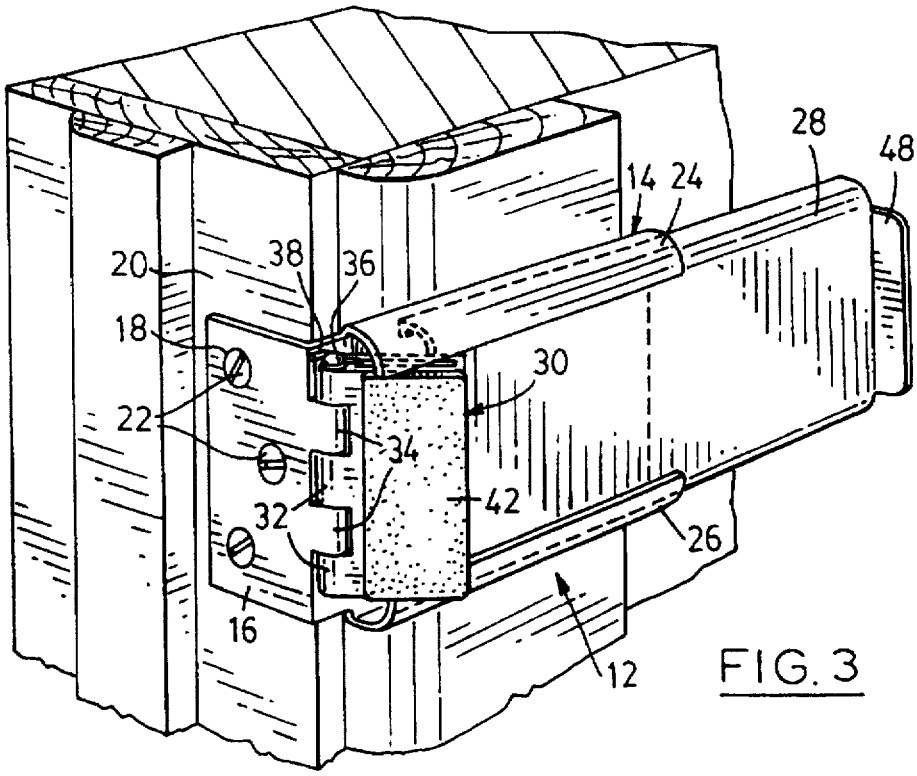
FIG. 3 is a perspective view showing the door lock secured to a door frame, the lock being in the unlocked configuration.
Figure 4:
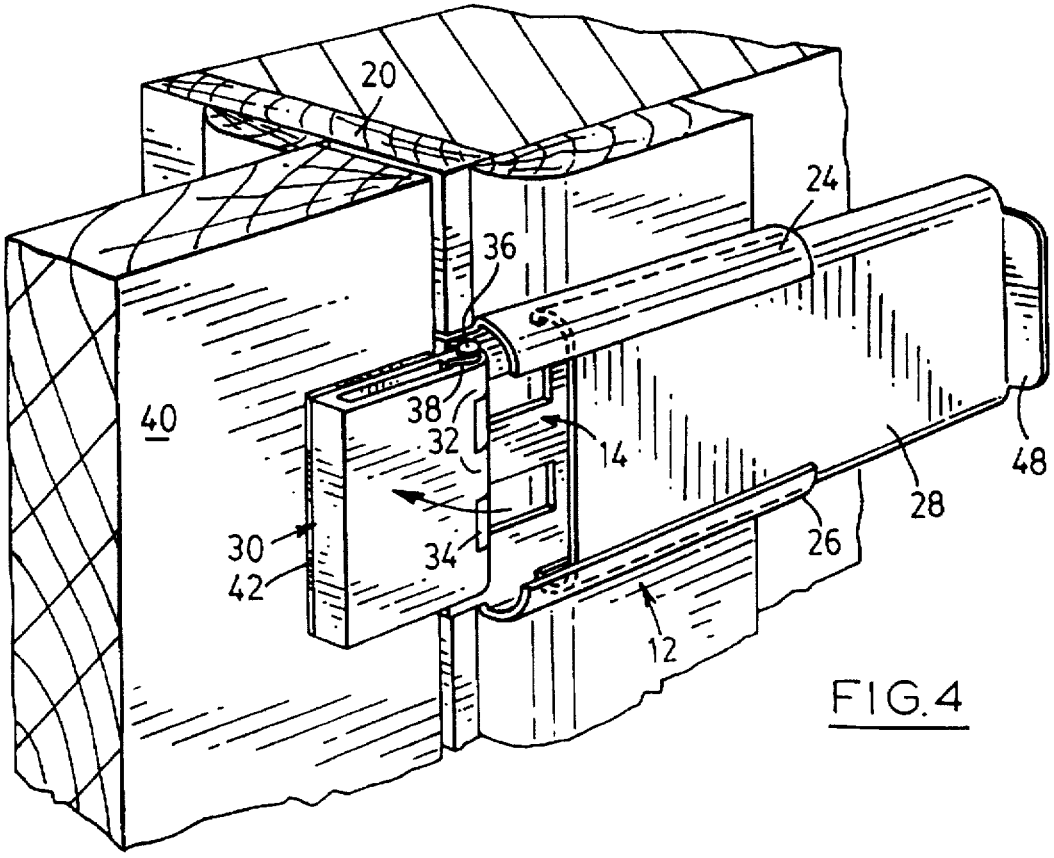
FIG. 4 is a similar view showing the locking arm moved to the blocking position.

FIG. 3 shows the door lock with the locking member 28 in the unlocking position and the locking arm 30 in the retracted position. FIG. 4 shows the locking arm 30 after being moved manually (by a hand not shown) against the force exerted by the spring 38 to a blocking position where the locking arm 30 blocks opening movement of a door 40. The locking arm 30 carries a resilient pad 42 which engages the door 40.

Figure 5:
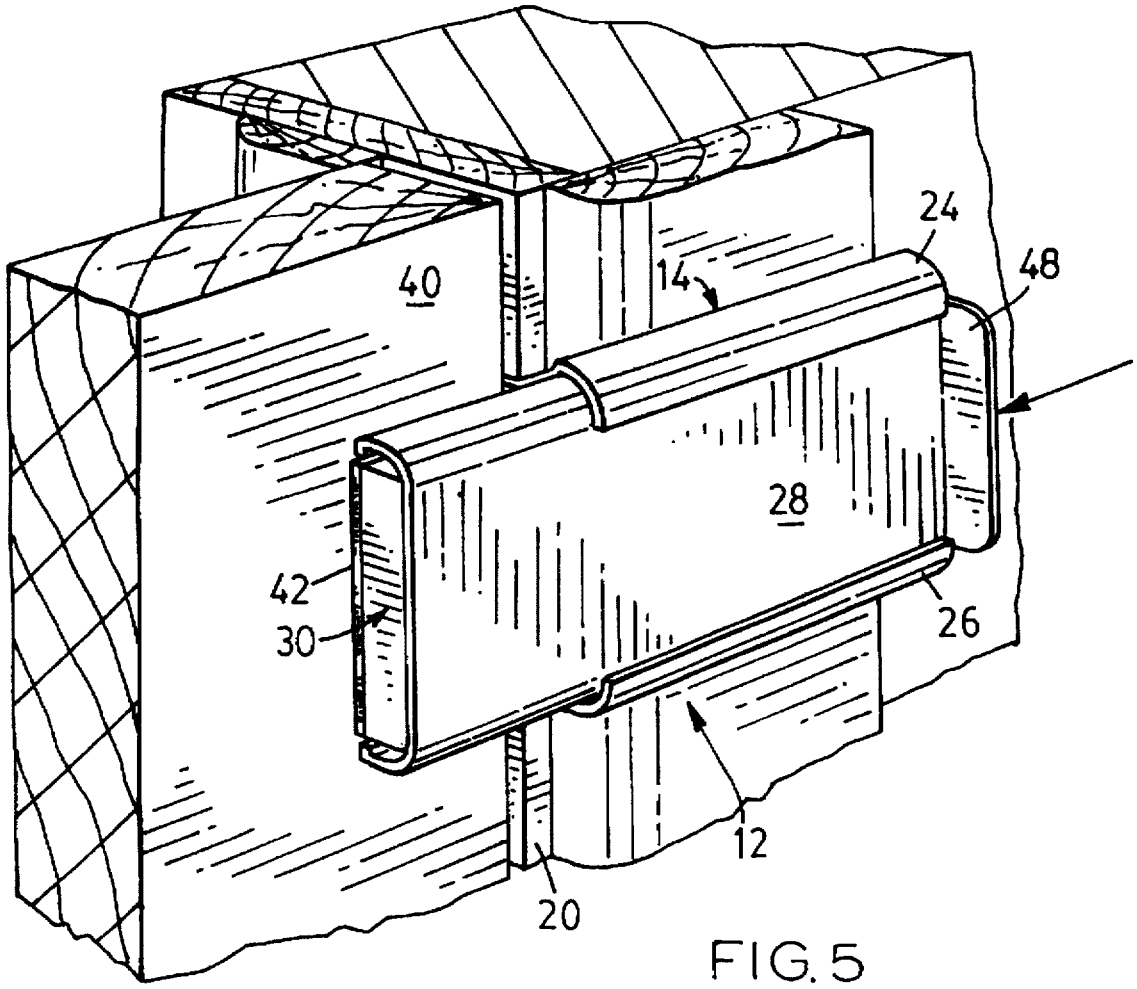
FIG. 5 is a similar view showing the locking member in the locking position.

FIG. 5 shows the locking member 28 after manual sliding movement from the unlocking position shown in FIG. 4 to the locking position in which the locking member 28 engages the locking arm 30 and retains the locking arm 30 in the door blocking position, thereby preventing the door 40 from opening.

The locking arm 30 can be released by sliding the locking member 28 back to the unlocking position shown in FIG. 4, where upon the ring 38 returns the locking arm 30 to the unblocking position shown in FIG. 3.

Unlocking movement of the body member 28 is limited by engagement of a stop 44 on the main body 14 with the end of a recess 46 in the locking member 28. Locking movement of the locking member 28 is limited by engagement of a flange 48 on the locking member 28 with the ends of the guides 24, 26 on the main body 14. The flap 48 also serves as a hand grip for sliding the locking member 28 between the unlocking and locking positions.

Figure 6:
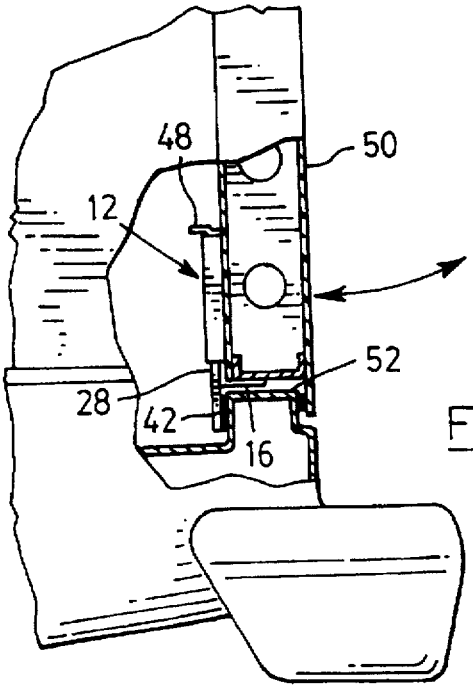
FIG. 6 is a side view, partly in section, of a portion of the rear end of a van with a door lock in accordance with the invention locking the rear door of the van in the closed position.

FIG. 6 shows a door lock in accordance with the invention secured to the lower inside portion of a van door 50 with the locking arm 30 being held by the locking member 28 in engagement with the inside of the rear end 52 of the floor of the van body.

The advantages of the invention will be clearly evident from the foregoing description of the embodiments thereof. Other embodiments will be readily apparent to a person skilled in the art.

I claim:

1. A door lock comprising a base securable to a door or door frame, a locking arm pivotally connected to the base and movable when the base is secured to the door or the door frame to a blocking position where the door is prevented from opening and a retracted position where the locking arm is retracted from the door locking position, biasing means biasing the locking arm to the retracted position to facilitate closing the door when the base is secured to the door or to the door frame, locking means slidably mounted on the base for sliding movement to a locking position in a direction parallel to the plane of the door to engage the locking arm and hold the locking arm in the blocking position against the biasing means when the door is closed, thereby locking the door, and a hinge pin pivotally connecting the locking arm to the base, said biasing means comprising a spring mounted on the hinge pin and having opposite ends engaging the base and the locking arm respectively to bias the locking arm to the retracted position.

2. A door lock comprising a base securable to a door or door frame, a locking arm pivotally connected to the base and movable when the base is secured to the door or the door frame to a blocking position where the door is prevented from opening and a retracted position where the locking arm is retracted from the door locking position, biasing means biasing the locking arm to the retracted position to facilitate closing the door when the base is secured to the door or to the door frame, and locking means slidably mounted on the base for sliding movement to a locking position in a direction parallel to the plane of the door to engage the locking arm and hold the locking arm in the blocking position against the biasing means when the door is closed, thereby locking the door, the base having a main body and a plate member perpendicular thereto, the main body having upper and lower edges bent over to form guides in which the locking means is slidably mounted, and the plate member having holes to enable the plate member to be secured to a door frame by screws passing through said holes into the door frame, and the main body of the base having a stop operable to limit sliding movement of the locking means in an unlocking direction.

3. A door lock according to claim 2 wherein the locking means has a stop which engages the main body of the base to limit movement of the locking means in the locking direction.

* * * * *